US005088235A

United States Patent [19]

Trikilis

[11] Patent Number: 5,088,235

[45] Date of Patent: Feb. 18, 1992

[54] TURNSTILE CONTROL SYSTEM

[76] Inventor: Emmanuel M. Trikilis, 1545 W. 130th St., Brunswick, Ohio 44212

[21] Appl. No.: 580,664

[22] Filed: Sep. 11, 1990

Related U.S. Application Data

[63] Continuation-in-part of Ser. No. 397,050, Aug. 22, 1989, Pat. No. 4,989,368.

[51] Int. Cl.[5] ..... E06B 11/08

[52] U.S. Cl. ..... 49/42; 49/46; 403/326; 403/357; 403/379

[58] Field of Search ..... 49/42, 43, 46, 47, 44, 49/45; 403/324, 326, 357, 378, 379

[56] References Cited

U.S. PATENT DOCUMENTS

| | | | |
|---|---|---|---|
| 1,655,501 | 5/1926 | Hedley et al. . | |
| 1,791,922 | 1/1930 | Distler et al. . | |
| 1,933,725 | 11/1933 | Frankford . | |
| 2,757,942 | 8/1956 | Eberhart | 403/326 X |
| 3,397,486 | 8/1968 | Foxwell et al. . | |
| 3,421,783 | 1/1969 | Sakai | 403/357 |
| 3,978,613 | 4/1975 | Hayward et al. . | |
| 4,020,927 | 8/1976 | Collins . | |
| 4,299,512 | 11/1981 | Wagner | 403/357 |
| 4,358,909 | 7/1982 | Trikilis . | |

*Primary Examiner*—Philip C. Kannan

*Attorney, Agent, or Firm*—Fay, Sharpe, Beall, Fagan, Minnich & McKee

[57] ABSTRACT

A rotary gate control assembly includes a pivot rod on which the rotary gate is adapted to rotate and a cam having a continuous cam surface with a plurality of lobes disposed at spaced intervals therealong for defining a plurality of rotary gate home positions with the cam being operatively secured to the pivot rod. A first member, which can be a ball or a rod, is cooperatively positioned relative to the cam surface for selectively allowing a rotationaly movement of the cam generally for an angular extent at least equal to an angle defined between adjacent ones of the lobes. Preferably, a second such member is also cooperatively positioned relative to the cam surface for the same purpose. The second member is spaced from the first member.

20 Claims, 6 Drawing Sheets

FIG. 2
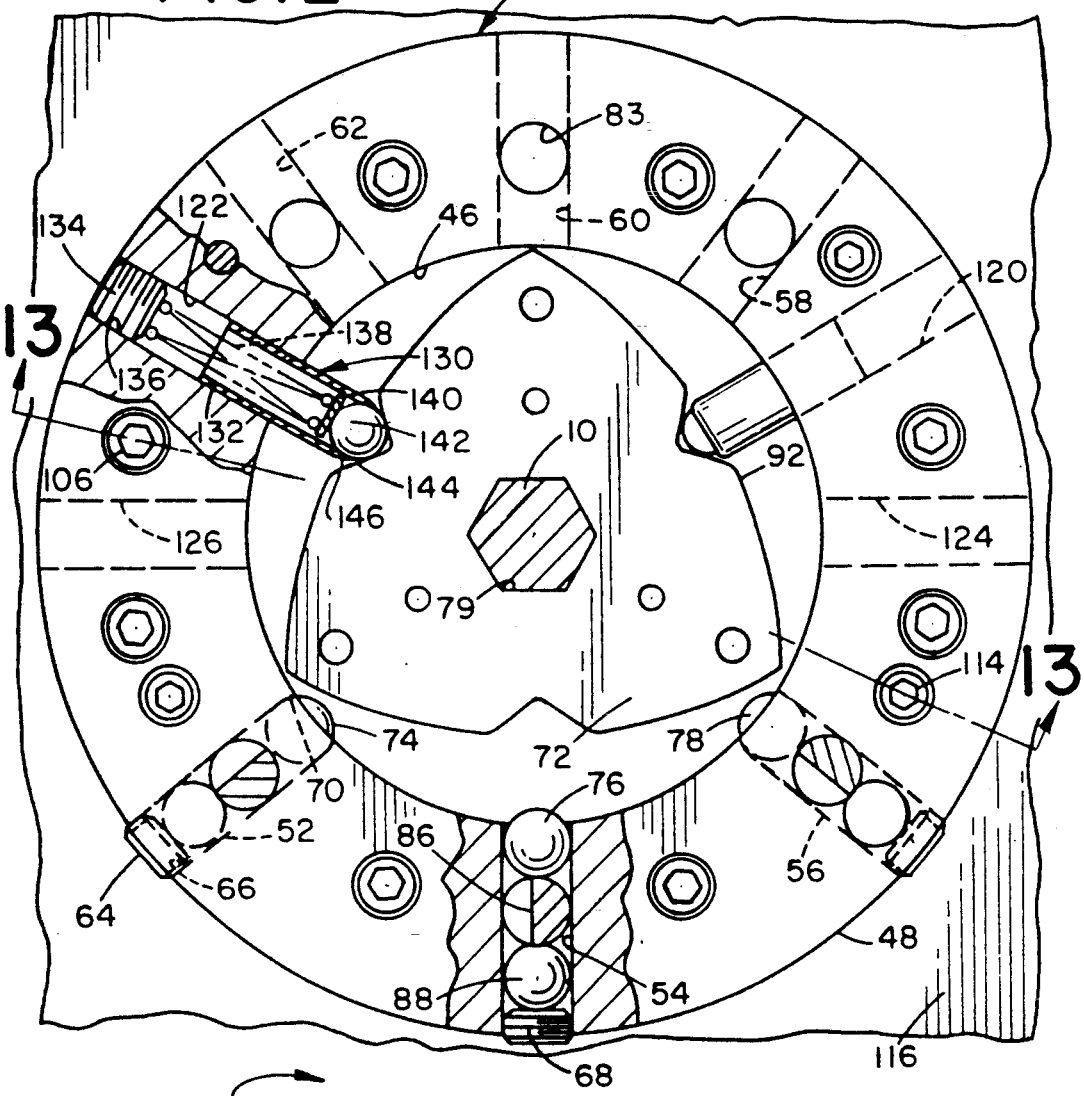
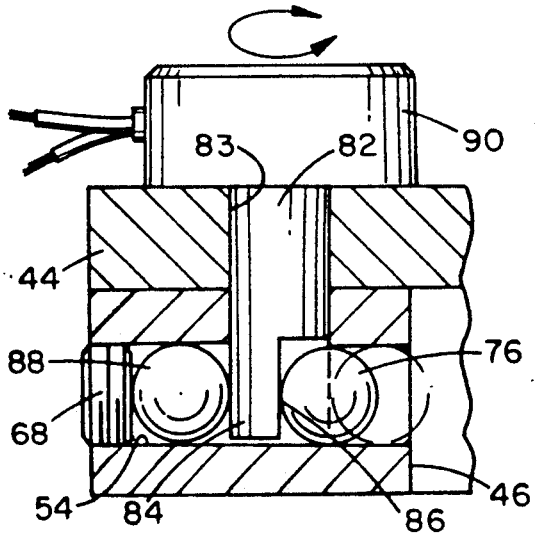
FIG. 3
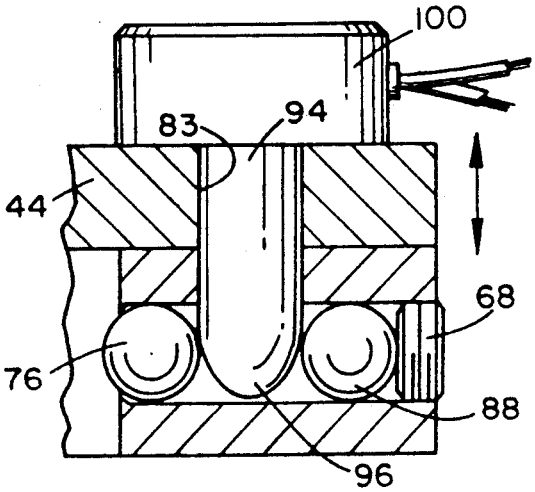
FIG. 5

FIG.7
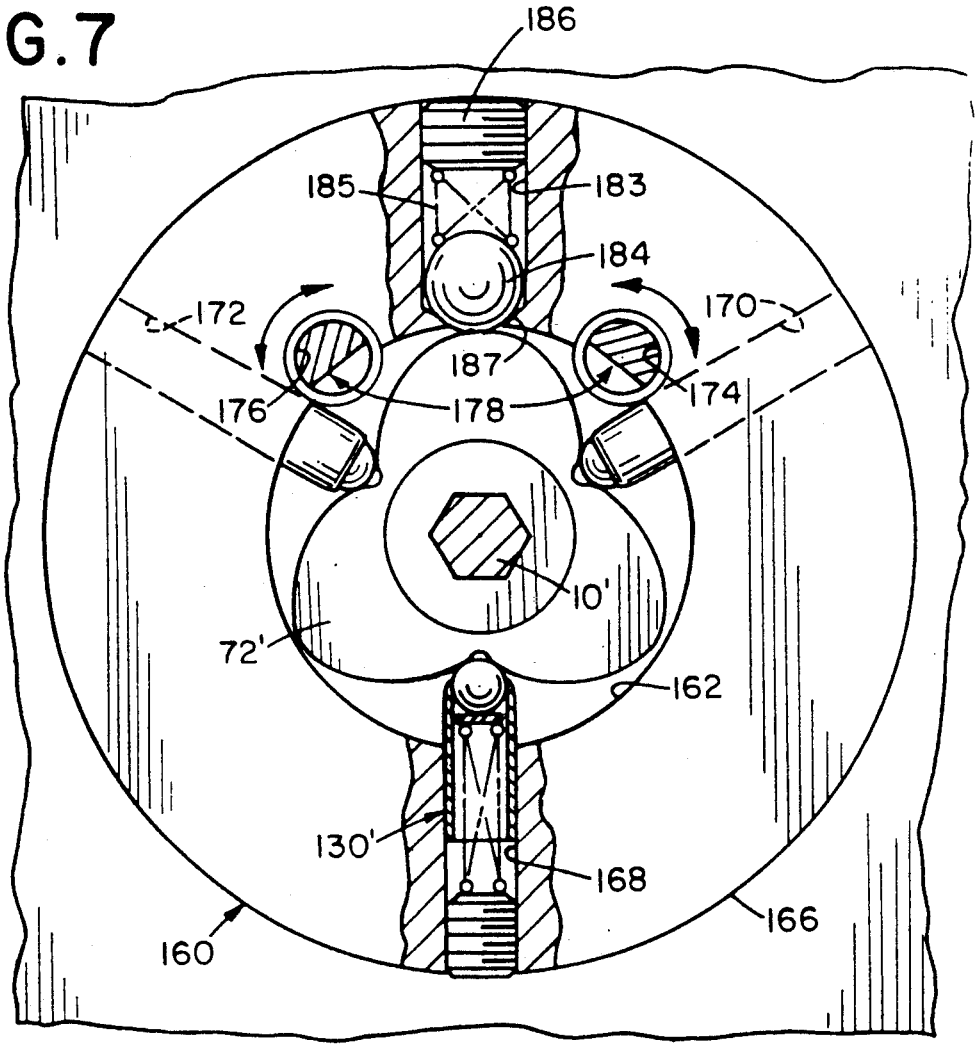
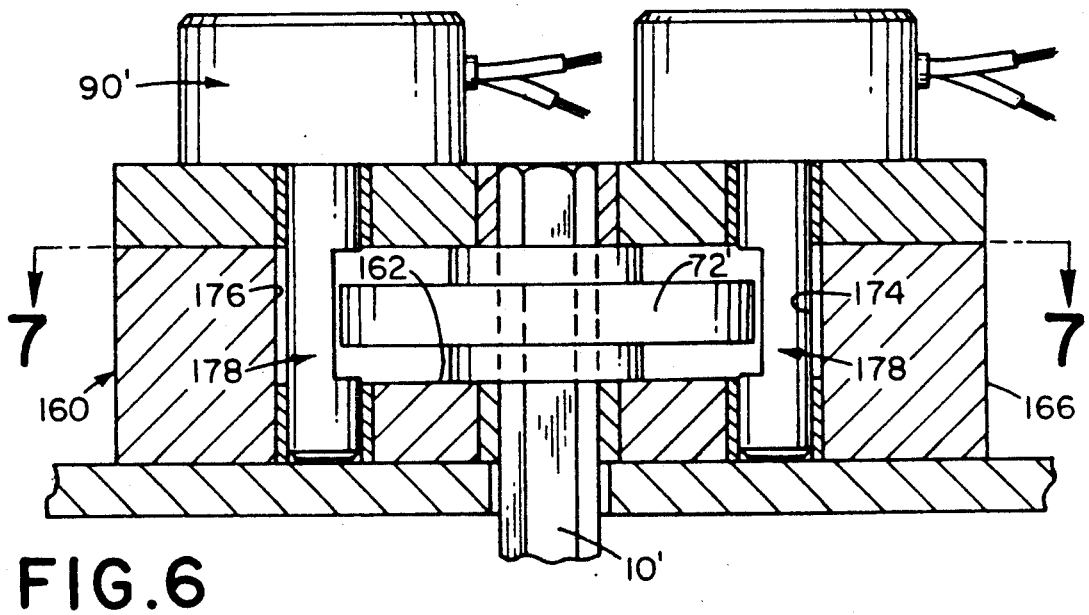
FIG.6

FIG. 10
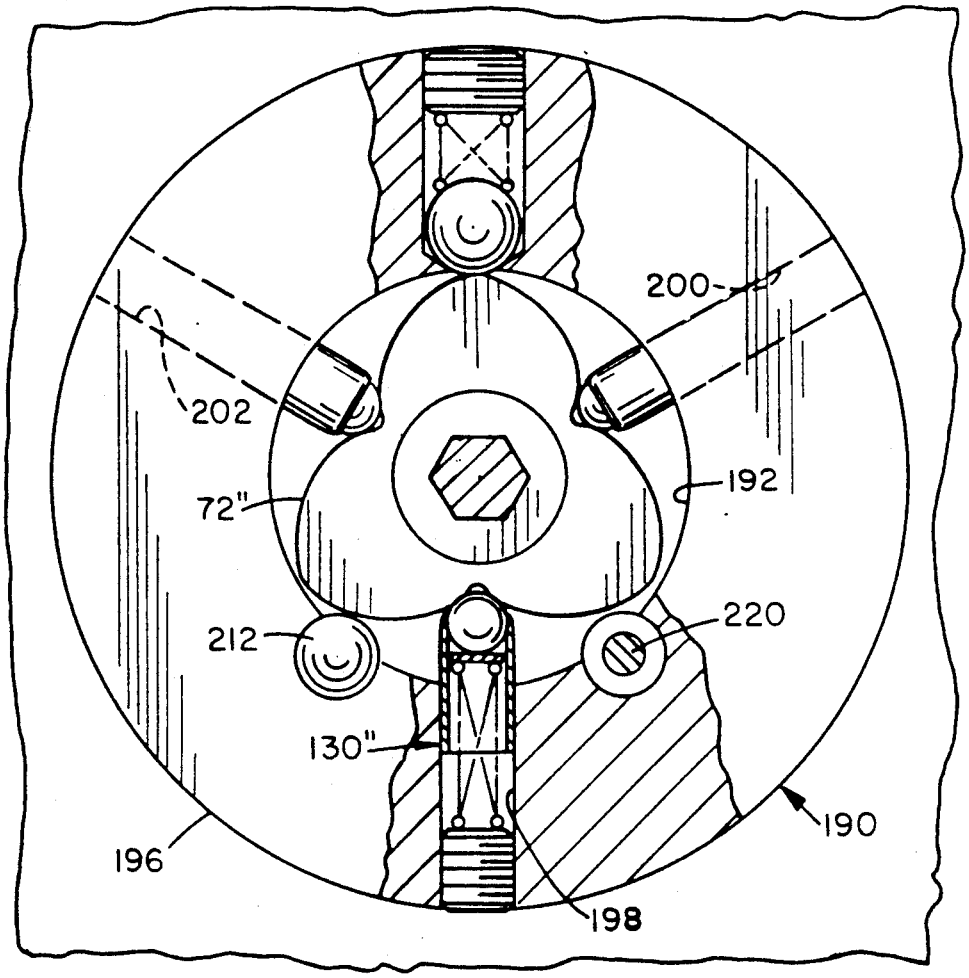
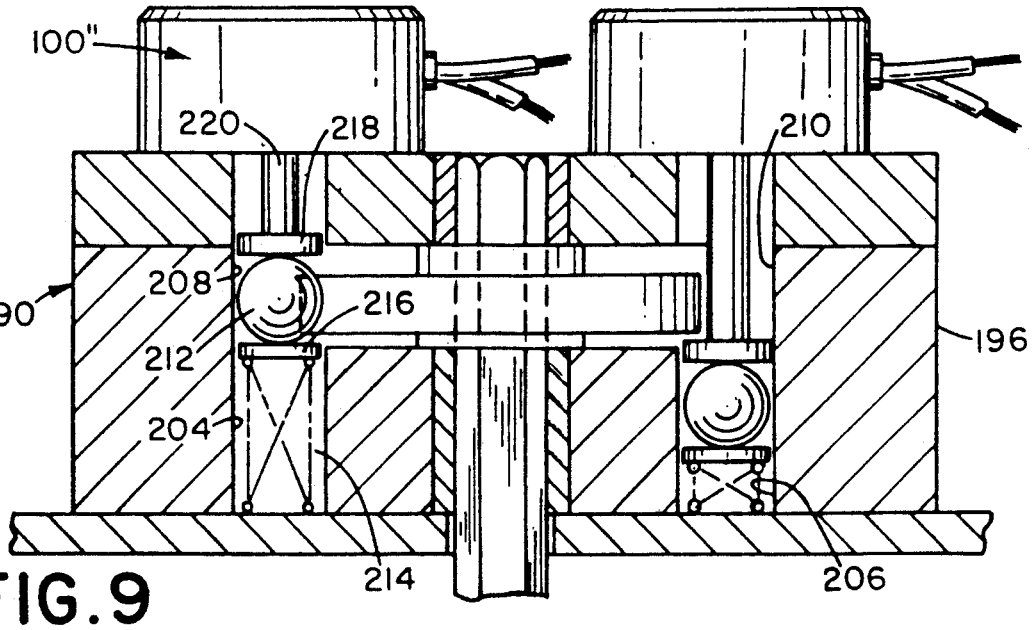
FIG. 9

TURNSTILE CONTROL SYSTEM

BACKGROUND OF THE INVENTION

The present application is a continuation-in-part of application Ser. No. 397,050 filed on Aug. 22, 1989 and issued as U.S. Pat. No. 4,989,368 on Feb. 5, 1991. This invention pertains to the art of access controls. More particularly, the present invention relates to rotary gate devices which facilitate controlled passage between two separated areas.

The invention is particularly applicable to a turnstile for use in controlling and/or monitoring the passage of personnel between two distinct areas, such as at entrances and exits into and out of buildings or other facilities. However, it will be appreciated by those skilled in the art that the invention can be readily adapted for use in other rotary gate environments such as revolving doors and the like.

As is well known, turnstiles comprise generally a cage-like structure including a vertically disposed pivot column having vertically aligned rows of barrier arms extending radially outwardly from the column. It is also known to provide a rotor control mechanism in order to selectively allow the rotation of the pivot column and hence regulate the ingress and egress of people between two distinct areas. Problems have been encountered by the conventional rotor control mechanisms in that they have not been particularly reliable and have not provided the degree of flexibility in operation to accommodate the various desired rotor operational modes.

More specifically, a particular difficulty with rotor control mechanisms has been the locking and unlocking means for the cam which is operatively secured to the pivot column in order to regulate the degree of rotation of the pivot column. Such means selectively enables the cam, and hence the pivot column, to rotate a desired amount and, controls the entry and egress of people between two distinct areas. The conventional rotor control locking and unlocking means have been complicated, expensive and usually were unable to cope with situations where pressure was exerted against the barrier means of the pivot column. Under those circumstances, the turnstile would not unlock and this made it difficult to try and move people efficiently and safely at the greatest speed. With everyone pushing, it is difficult for anyone to back up in order to disengage the locking mechanism so that the turnstile could be turned.

Another problem with conventional turnstiles has been the locking system for the barrier arms which are secured to the turnstile pivot column. Conventional constructions do not allow a barrier arm to be so rigidly attached to the pivot column as to prevent any play of the arms when someone attempts to pull a barrier arm out of the pivot column and yet at the same time allow the barrier arms to be selectively removed from the pivot column for purposes of replacement, repair or the like.

The present invention contemplates a new and improved apparatus which overcomes all of the above referenced problems and others and provides a new rotary gate control system and a turnstile construction which is simple in design, economical to manufacture, light in weight, and of considerable strength, as well as being reliable for a range of operational modes and readily adapted to a variety of applications.

BRIEF SUMMARY OF THE INVENTION

In accordance with the present invention, a new and improved rotary gate control assembly is provided.

More particularly in accordance with the invention, the assembly comprises a pivot rod on which the rotary gate is adapted to rotate and a cam having a continuous cam surface with a plurality of lobes disposed at spaced intervals therealong for defining a plurality of rotary gate home positions. The cam is operatively secured to the pivot rod. A first control means is cooperatively positioned relative to the cam surface for selectively allowing a rotational movement of the cam generally for an angular extent at least equal to an angle defined between adjacent ones of the lobes.

In accordance with another aspect of the invention, a rotary gate control assembly is provided.

More particularly in accordance with this aspect of the invention, the assembly comprises a pivot rod on which the rotary gate is adapted to rotate, and a cam having a continuous cam surface with a plurality of lobes disposed at spaced intervals therealong for defining a plurality of rotary gate home positions. The cam is operatively secured to the pivot rod. A first element is cooperatively positioned relative to the cam surface and in operative engagement with the cam surface for selectively allowing a rotational movement of the cam for an angular extent greater than an angle defined between adjacent ones of the plurality of lobes. A first means selectively moves the first element into and out of a rotation preventing relationship with the cam surface. A second element is cooperatively positioned relative to the cam surface and in operative engagement with the cam surface for allowing a rotational movement of the cam to an angular extent greater than an angle defined between adjacent ones of the lobes. A second means selectively moves the second element into and out of a rotation preventing relationship with the cam surface.

In accordance with yet another aspect of the invention, a rotary gate control assembly is provided.

More particularly in accordance with this aspect of the invention, the assembly comprises a pivot rod on which the rotary gate is adapted to rotate and a cam having a continuous cam surface with a plurality of lobes disposed at spaced intervals therealong for defining a plurality of rotary gate home positions. The cam is operatively secured to the control rod. The control head having an interior cavity is provided in which cavity the cam is mounted for rotation. A first ball member is cooperatively positioned in the control head relative to the cam surface for selectively preventing a bi-directional rotational movement of the cam generally for an angular extent at least equal to an angle defined between adjacent ones of the lobes. The first ball member is movable in a direction normal to the plane of the cam to allow a rotation of the cam. A second ball member is cooperatively positioned in the control head relative to the cam surface for selectively preventing a bi-directional rotational movement of the cam for an angular extent at least equal to an angle defined between adjacent ones of the lobes. The second ball member is movable in a direction normal to a plane of the cam to allow rotation of the cam.

In accordance with a further aspect of the invention, a revolving door construction is provided.

More particularly in accordance with this aspect of the invention, the revolving door construction comprises an elongated pivot column having at least one groove extending longitudinally therealong, with a plurality of barrier members, which are adapted to be held in said groove and are arranged to extend radially outward of said groove. A locking means is concealably contained in the pivot column and interposed between a side wall of said groove and a terminal end of each barrier member mountingly associated therewith for retaining said barrier member in said groove. The locking means comprises a second groove which extends longitudinally along said side wall of each first groove and, a resilient locking member extending in said second groove.

One advantage of the present invention is the provision of a new rotary gate control assembly that is constructed from a minimum number of components.

Another advantage of the present invention is the provision of a rotary gate control assembly which is sturdy, inexpensive to manufacture and can be retrofitted onto existing rotary gate mechanisms.

Still another advantage of the present invention is the provision of a rotary gate control assembly which can be readily disassembled so that the elements thereof can be repaired or replaced as necessary.

Yet another advantage of the present invention is the provision of a rotary gate assembly which utilizes a set of movable balls in order to control the rotation of a cam of the assembly.

Still yet another advantage of the present invention is the provision of a rotary gate assembly which utilizes a set of movable rods in order to control the rotation of a cam of the assembly.

A further advantage of the present invention is the provision of a solenoid actuated mechanism for selectively moving an element into and out of a rotation preventing relationship with a cam surface.

A still further advantage of the present invention is the provision of a rotary gate control mechanism which utilizes a control head that can be adapted for use with either three or four lobed cams.

A yet further advantage of the present invention is the provision of a turnstile with arms that can be securely locked in place when the turnstile is assembled on site (instead of at the factory) and yet allows the arms to be selectively removed for repair or replacement.

Still other benefits and advantages of the subject new rotary gate control assembly and turnstile construction will become apparent to those skilled in the art upon a reading and understanding of this specification.

BRIEF DESCRIPTION OF THE DRAWINGS

The invention may take physical form in certain parts and arrangements of parts, the preferred and alternate embodiments of which will be described in this specification and illustrated in the accompanying drawings which form a part hereof and wherein:

FIG. 2 is a top plan view of a rotary gate control assembly utilizing a three lobed cam according to a first preferred embodiment of the present invention;

FIG. 3 is an enlarged side elevational view in cross-section of a portion of the control head of FIG. 2;

FIG. 5 is an enlarged side elevational view in cross-section of a portion of the control head of FIG. 4;

FIG. 6 is a side elevational view of a control head according to a first alternate embodiment of the present invention;

FIG. 7 is a top plan view of the control head of FIG. 6;

FIG. 9 is a side elevational view of a control head according to a second alternate embodiment of the present invention;

FIG. 10 is a top plan view of the control head according to FIG. 9;

DETAILED DESCRIPTION OF THE PREFERRED AND ALTERNATE EMBODIMENTS

Figure 1:
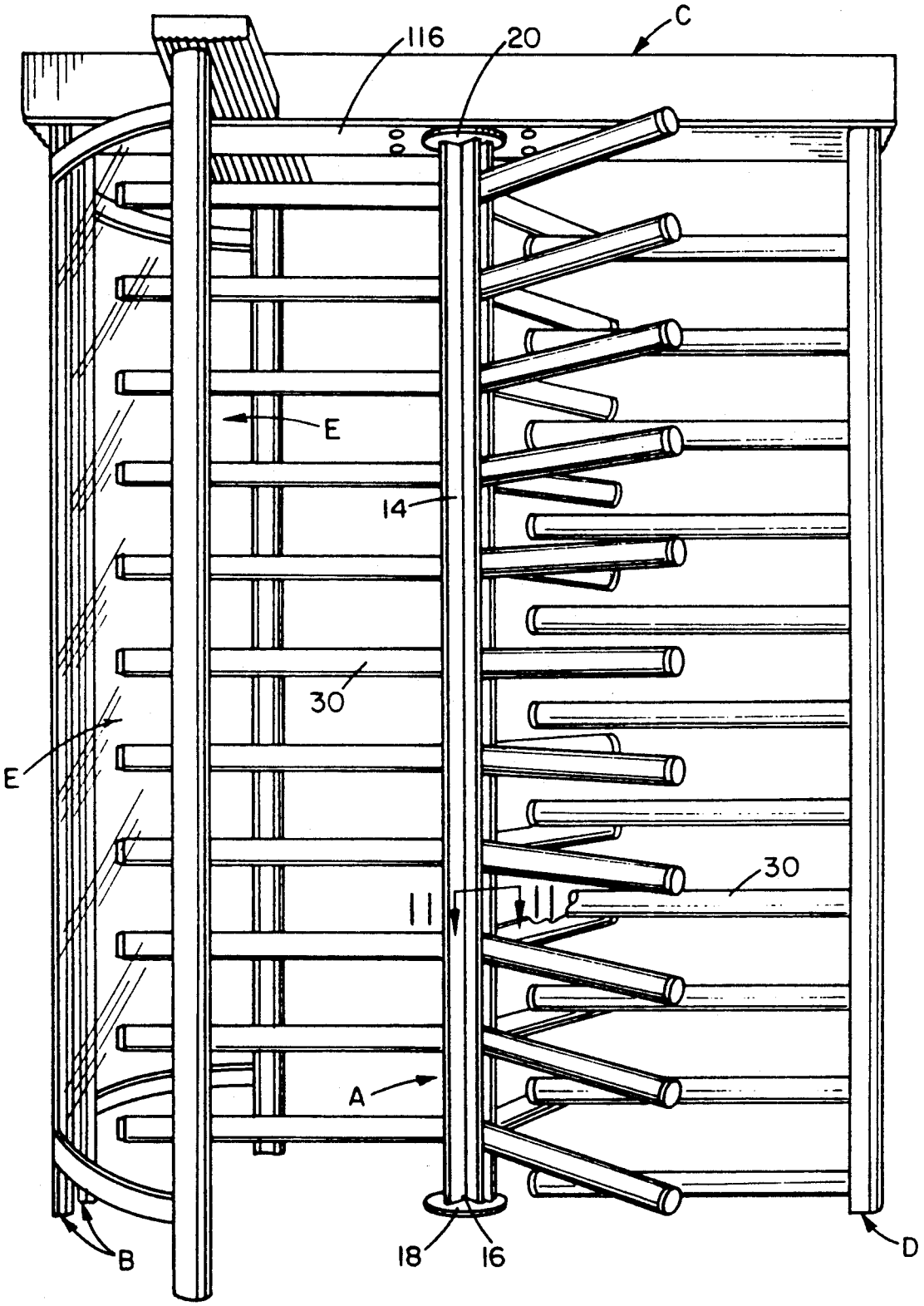
FIG. 1 is a perspective view of a turnstile utilizing the rotary gate control assembly according to the present invention.

Referring now to the drawings wherein the showings for purposes of illustrating the preferred and alternate embodiments of the invention only and not for purposes of limiting same, FIG. I shows a turnstile construction comprising a turnstile rotor A, a plurality of mounting columns B, an overhead support frame C, to which the rotor and the mounting columns are secured together with a barrier column D and a pair of cage panels E which are secured between the mounting columns B. While the rotary gate construction of the present invention is primarily designed for and will hereinafter be described in connection with a specific type of turnstile installation, it will be appreciated that the overall inventive concept involved could be adapted for use in many other entry and exit control environments including revolving doors and the like.

More specifically, the turnstile rotor A includes a hexagonally-shaped pivot rod 10 (FIG. 11) which is located in a hexagonally-shaped aperture 12 of a pivot column 14. The pivot column 14 is journaled for selectively rotation about its longitudinal axis. To that end, and in the preferred construction illustrated in FIG. I, a pivot column base end 16 is mounted upon a suitable bearing 18 such as a polymeric cone bearing, and a pivot column upper end portion 20 is mounted in the overhead support frame C. The lower bearing 18 can be of a suitable conventional construction such as a male and female construction in which the male part is fixedly secured to the surface or floor area upon which the turnstile rests with the female part journally receiving the male part. In this way, the weight of the rotor A is primarily borne by the surface or floor area through the male part. Of course, other mounting arrangements could also be satisfactorily employed as desired.

Secured to the pivot column 14 are a plurality of identical turnstile arms 30 extending radially outwardly therefrom. The turnstile arms 30 are aligned in generally vertically disposed rows for defining a plurality of barrier planes. It is also evident that the barrier column D is similarly provided with a plurality of arms 30 which extend toward the pivot column 14. However, the arms 30 secured to the barrier column D are so positioned in relation to the arms 30 of the pivot column that the barrier column arms will be laterally spaced apart relative to each other from the pivot column arms in order to allow for free passage of the pivot column arms between the barrier column arms when the pivot column 14 is itself rotated about its longitudinal axis during turnstile operation.

With reference now also to FIG. 2, a control head 40 is located in the overhead support frame C and is employed to selectively allow rotation of the pivot column 14. The control head 40 comprises a base 42 and a cover plate 44 (FIG. 13) which between them define an inner cavity 46. Communicating between an outer periphery 48 of the base 42 and the inner cavity 46 are first, second, third, fourth, fifth and sixth bores 52, 54, 56, 58, 60 and 62. Each of these bores includes an outer end 64 which has a threaded area 66, for accommodating a set screw 68, as well as an inner end 70 which is of a somewhat smaller diameter than the outer end. More specifically, the outer end, and the rest of the bore excluding the inner end, preferably has a 0.752 inch diameter whereas the inner end has a 0.625 inch diameter.

The first three of these bores 52, 54 and 56 are spaced apart from each other at angles of approximately 51°, whereas the latter three of the bores 58, 60 and 62 are spaced apart by angles of approximately 37½. The first three bores 52, 54 and 56 are utilized when a three lobed cam 72 is employed as is illustrated in FIG. 2. In that circumstance, positioned in each of the bores 52, 54 and 56 is a cam contact element, such as a ball 74, 76 and 78 respectively, for selectively blocking rotation of the three lobed cam 72. These balls selectively extend partially into the cavity 46 and interfere with the attempted rotation of the cam 72.

More specifically, the balls prevent a rotational movement of the cam 72 for an angular extent at least equal to an angle defined between adjacent ones of the lobes of the cam. As is evident, for a three lobed cam, such lobes are located 120° apart and thus a rotation of the cam by 120° or more is prevented by the balls. In fact, even if only two such balls are present, such as balls 74 and 78, rotation of the cam by 120° is prevented. Since balls 74 and 76 are spaced apart by 51°, the amount of uncontrolled rotation that the cam 72 can undergo is not much more than about 60°. The centrally located ball 76 serves as an anti-backup feature for the turnstile. In other words, once one of the lobes of the cam 72 has rotated clockwise or counterclockwise past the ball 76, the ball would then prevent any attempted rotation of the cam lobe back against the direction of rotation. This feature is advantageous in order to prevent a second person from attempting to sneak in through a turnstile or other rotary gate mechanism with a first person.

It is noted that the pivot rod I0 extends vertically through a hexagonally shaped hole 79 in the middle of the cam 72.

In order to control the movement of the balls 74, 76 and 78, the mechanism illustrated in FIG. 3 can be employed. Such mechanism includes a metal rod 82 extending through a hole 83 in the cover plate 44 into, e.g. the bore 54. The rod 82 has a lower end 84 which is provided with a recessed region 86. Located opposite the ball 76, on the other side of the rod lower end 84 is a second, outer, ball 88. As shown in FIG. 3, the set screw 68 is threaded so far into the bore in question that the screw's inner end is located directly adjacent the second, outer, ball 88. This metal rod 82 is controlled by a conventional rotating solenoid 90 secured to the cover plate 44. When the solenoid 90 rotates the rod 82 such that the recessed region 86 is facing the ball as shown in FIG. 3, then the cam 72 can push the ball out of the way and thus the pivot column 14 is allowed to rotate. However, when the solenoid 90 rotates the rod 82 so that a straight side wall of the steel rod is presented towards the ball 76 as shown in FIG. 2, then the ball cannot be pushed out of the way by the cam 72 since an outer periphery 92 thereof will impact the ball 76 and thus the pivot column 14 is blocked from rotation.

The advantage of using spaced inner and outer balls 76 and 88 is that less surface is exposed on the rod 82 to the balls, in essence just a contact point on each side. Therefore less solenoid force is required from the rotating solenoid 90 in order to allow the inner ball 76 to be moved by the rod 82. This approaches an instant release type feature for the rotary gate mechanism which is quite advantageous.

With reference now also to FIG. 5, another control means for the operation of the balls 74, 76 and 78 includes a metal rod 94 having generally semi-spherical lower end 96. This metal rod 94 reciprocates in an up and down manner as controlled by a conventional push pull solenoid 100. When the metal rod is in its lower position, the inner ball 76 is prevented from retracting into the bore and thus, as is illustrated in FIG. 2, the ball will prevent the rotation of the cam 72 since it interferes with the outer periphery 92 of the cam. However,, when the metal rod 94 is raised by the push pull solenoid 100, the ball 76 is allowed to be pushed out of the way by the cam outer periphery 92 as the cam 72 rotates.

The solenoids 84 and 100 can be either of the fail lock type or the fail safe type. A fail lock type solenoid is such that when the power is turned off, the ball 76 is locked in place to prevent the cam from rotating. In contrast, the fail safe type is such that the ball 76 is not prevented from retracting back in the bore and thus the cam is allowed to rotate. In other words, with a fail lock type solenoid 90 the slot 86 would not be facing the ball 76 as it would with a fail safe type solenoid. Similarly, with a fail lock type solenoid 100 the rod lower end 96 would prevent the ball 76 from retracting whereas with a fail safe type the rod would be lifted in order to allow the ball to retract.

Figure 13:
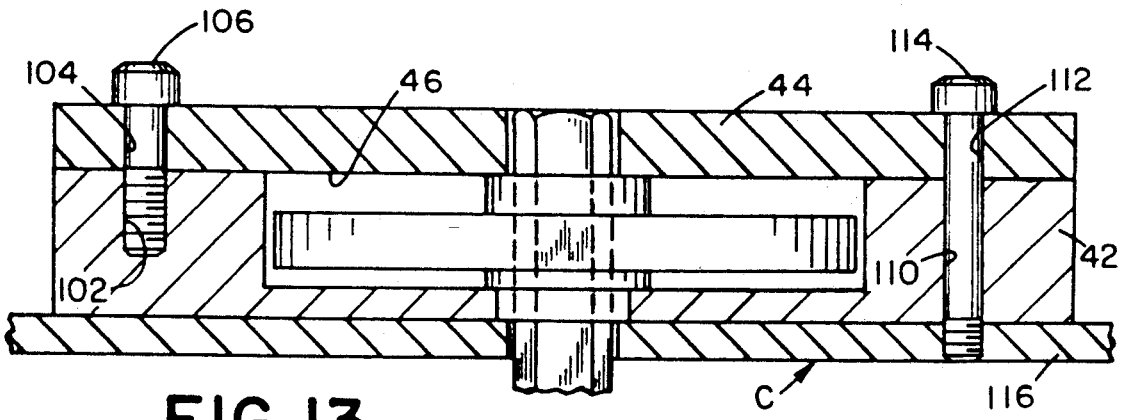

With reference now to FIG. 13, a plurality of first vertical apertures 102 are provided in the base 42 and mating apertures 104 are provided in the cover plate 44 so as to accommodate suitable fasteners 106 in order to secure the base 42 and the cover plate 44 to each other. A second set of vertically aligned apertures 110 and 112 are provided in the base 42 and the cover plate 44, in order to accommodate suitable fasteners 114 which secure the control head to a wall 116 of the support frame C.

With reference again to FIG. 2, also provided in the control head base 42 are a plurality of cam follower mounting bores. More specifically, first and second cam follower mounting bores 120 and 122 are provided in the base 42 spaced 120° apart. These mounting bores are utilized for holding cam followers when the three lobed cam 72 is employed. Two mounting bores 124 and 126 are located opposite each other and are utilized when a four lobed cam is employed. The cam follower bores each are meant to house a cam follower 130 that includes a tube 132 which is slidably mounted in the bore 120. A set screw 134 closes an outer end of the bore 120 and cooperates with a threaded end 136 thereof. A compression spring 138 is held within the bore 120 and also extends within the tube 132 to a disc 140 which is slidably positioned in the tube 132. A ball 142 rests against the front face of the disc 140. The ball is, in turn, held in place in a front end 144 of the tube 132 by curved lips 146 of the tube 132. The spring biased cam follower 130 is used to exert pressure against the cam 72 in order to assist the user in the use of the turnstile by softening the return of the turnstile barrier to its final rest position.

Figure 4:
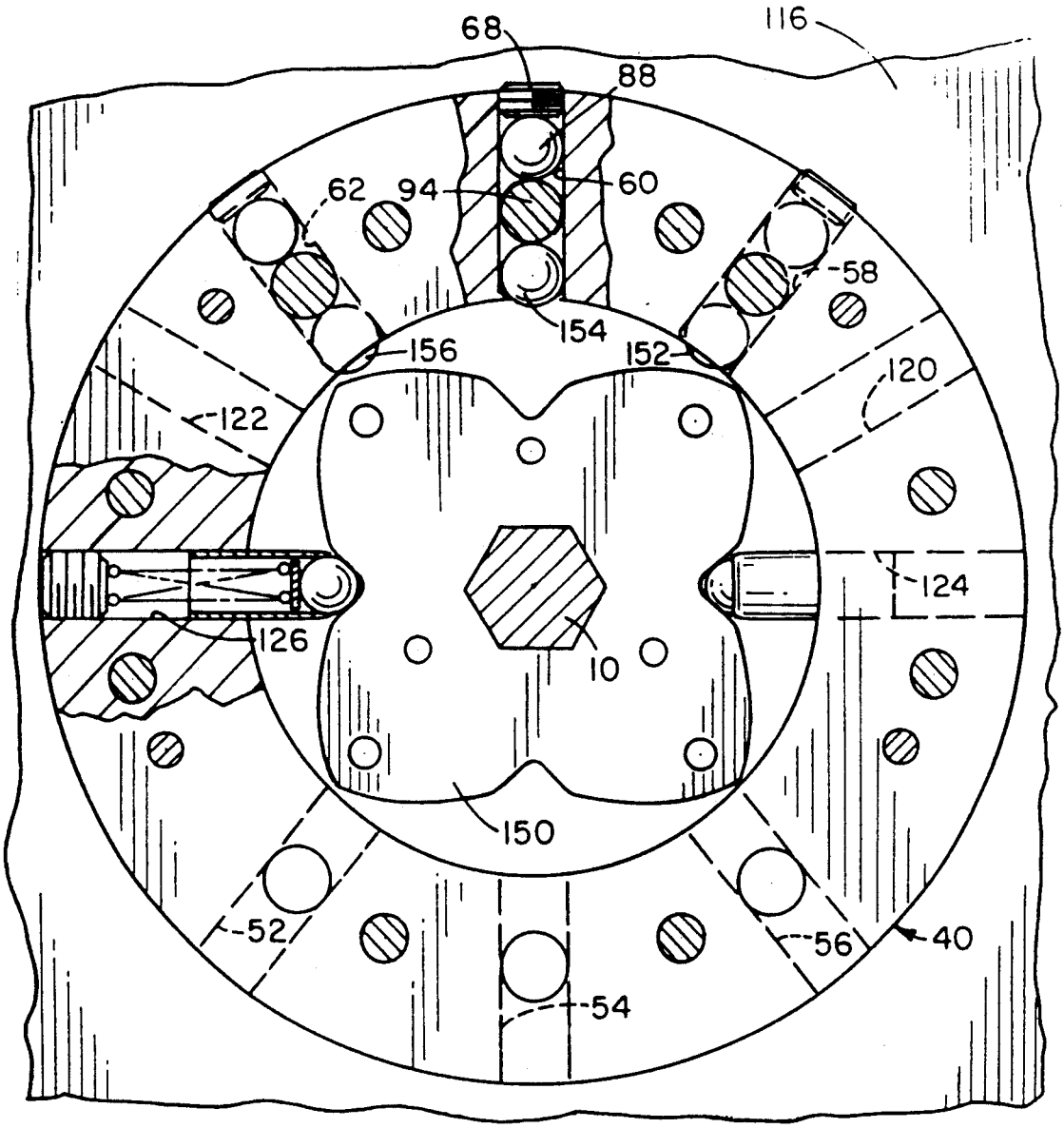
FIG. 4 is a top plan view of a rotary gate control assembly utilizing lobed cam according to a second preferred embodiment of the present invention.

With reference now also to FIG. 4, the use of a four lobed cam 150 in the control head 40 is there illustrated. When a four lobed cam is employed, the fourth, fifth and sixth bores 58, 60 and 62 are utilized to hold respective balls 152, 154 and 156. These balls can be controlled by either of the control mechanisms mentioned with regard to FIGS. 3 and 5 as desired. More specifically, the control mechanism of FIG. 5, employing the push-pull solenoid 100 is illustrated. Also, when the four lobed cam 150 is employed, the third and fourth cam follower mounting bores 124 and 126 are used.

With reference now to FIG. 6, an alternate embodiment of a control assembly according to the present invention is there illustrated. For ease of illustration and appreciation of this alternative, like components are identified by like numerals with a primed suffix (′), and new components are identified by new numerals.

Figure 8:
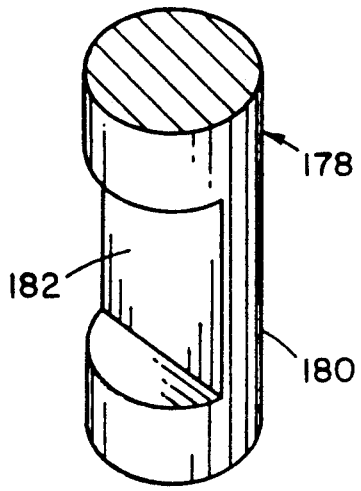
FIG. 8 is an enlarged perspective view of a control shaft utilized in the embodiment of FIG. 6.

In this FIG., a control head 160 has enclosed therein a cavity 162 in which rotates a three lobed cam 72′ as best shown in FIG. 7. Extending horizontally through the control head 160 from an outer periphery 166 to the cavity 162 are three bores 168, 170 and 172 for accommodating respective cam followers 130′. Located adjacent the cavity 162 in the control head are a pair of spaced vertically oriented semi-circular slots 174 and 176. Each of these slots is adapted to accommodate a respective bar 178 which is best illustrated in FIG. 8. The bar has a substantially cylindrical outer periphery 180 but also includes a recessed area 182 along one side thereof.

When the bar is rotated along its longitudinal axis such that the indented or recessed area 182 faces the cam 72′, the cam is then not blocked from rotation and thus the pivot column to which the cam is operatively secured is also enabled to rotate. However, when the bar 178 is rotated so that it's cylindrical outer periphery 180 faces the cam 72′, the cam is prevented from a rotational movement to an angular extent equal to an angle defined between adjacent ones of the lobes, i.e., an angle of 120°. Therefore, the pivot column to which a shaft 10′ extending through the cam 72′ is secured would also be prevented from rotating and entry and exit from the controlled area would be prevented. Controlling the rotation of the bar 178 is a suitable conventional rotary solenoid 90′.

Also extending longitudinally through the control head 160 is an additional bore 183 which accommodates a ball 184 that is biased by a spring 185 towards the cavity 162. A set screw 186 secures the spring 185 and ball 184 in place in the bore 183. A front end 187 of the bore 183 is of a smaller diameter than the ball to prevent the ball from exiting the bore. The ball 184 is useful in urging the cam 72′ to continue rotation as soon as the cam initially begins to rotate.

With reference now also to FIGS. 9 and 10, a second alternate embodiment of the invention is there illustrated. For ease of illustration and appreciation of this embodiment, like components will be identified by like numerals with a double primed (″) suffix and new components will be identified by new numerals.

In FIG. 10, a control head 190 encloses a cavity 192 in which is located a three lobed cam 72″. Extending between an outer periphery 196 of the control head 190 and the cavity 192 are first, second and third bores 198, 200 and 202. Each of these bores is adapted to accommodate a suitable cam follower 130″. Located adjacent the cavity 192 are spaced first and second vertically extending bores 204 and 206 which, in the area of the cavity 192, form semi-circular slots 208 and 210. Adapted to be contained in each of these slots 208 and 210 is a suitable ball 212.

As shown in FIG. 9, seated in the bore 204 below the ball is a compression spring 214 and resting atop the spring is a disc 216 which contacts a lower surface of the ball 212. Controlling the movement of the ball 208 is a suitable conventional push pull solenoid 100″ which is provided at its distal end with an enlarged disc 218 that contacts an upper surface of the ball 212. The disc is mounted on a shaft 220 that is reciprocated by the push pull solenoid 100″. When the solenoid is actuated to pull the disc 218 upwardly in the slot 208 away from the disc 216, the ball is urged upwardly by the spring 214 and into the path of rotation of the cam 72″. This then enables the cam to rotate thus also allowing the pivot column to be rotated as people enter and exit the restricted area.

Figure 11:
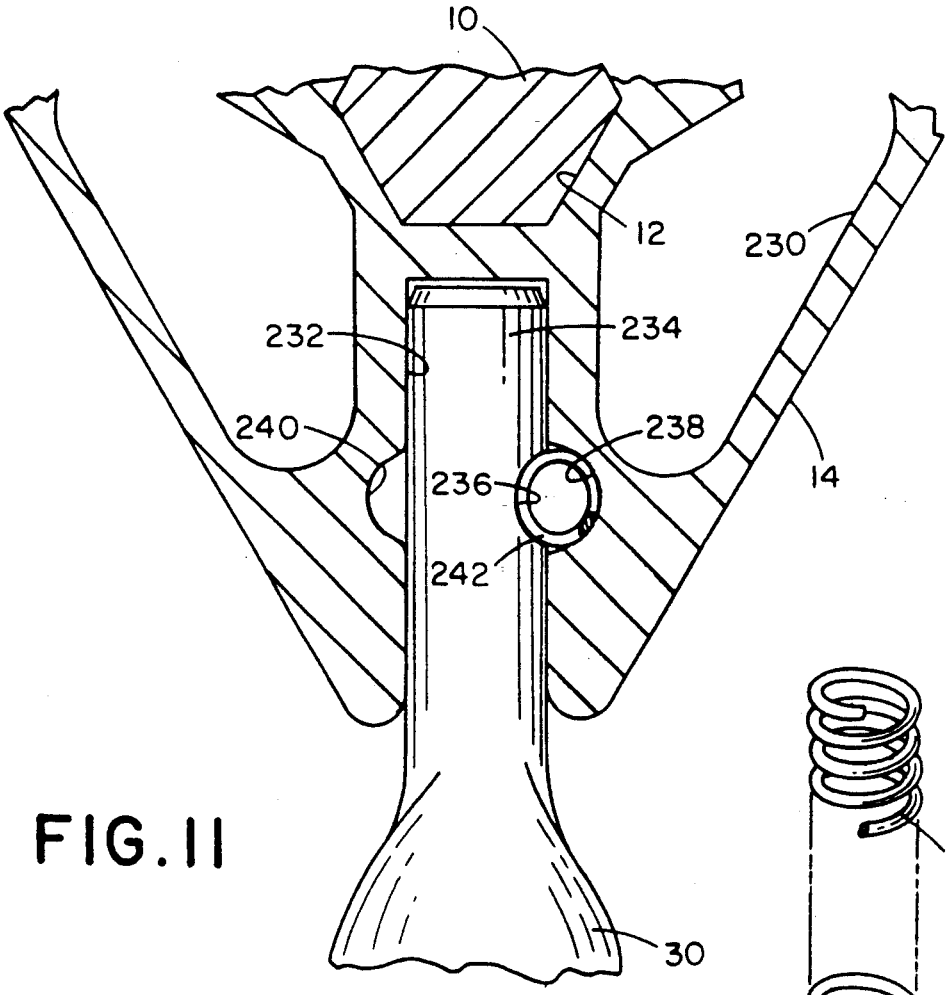
FIG. 11 is a greatly enlarged partial cross-sectional view through a pivot column and an arm of the turnstile of FIG. 1 along line 11—11.

With reference now to FIG. 11, a locking means is disclosed for holding or securing the turnstile arms 30 in place in the rotor column or pivot column 14. More specifically, the pivot column 14 includes hollowed-out areas 230 in order to reduce its weight. The pivot column also includes a plurality of slots 232 which extend vertically in the column 14. As is known, the column is preferably comprised of an elongated member extruded from aluminum or a like material. The slot or groove 232 can be integrally formed with the column at the time of extrusion in order to eliminate subsequent machining steps. An inner end 234 of each arm 30 is adapted to be received in the groove 232 and is pressed or otherwise formed into a highly elliptical shape. Moreover, the arm inner end 234 is provided with a trough portion 236. The pivot column portion adjacent the groove 232 can also be provided with at least one trough 238. In the embodiment illustrated, two such spaced troughs 238 and 240 are shown. The first column trough 238 adjoins the arm trough 236 in order to form a somewhat circular bore which accommodates a locking means therein.

Figure 12:
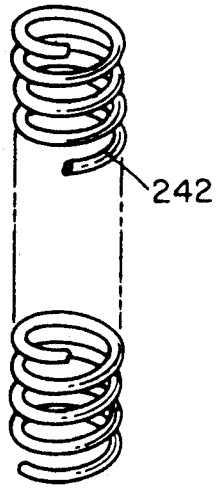
FIG. 12 is a side elevational view of a locking means for the arm of FIG. 11; and, FIG. 13 is a side elevational view in cross-section through the assembly of FIG. 2 along line 13—13.

With reference now also to FIG. 12, the locking means can comprise a compression spring 242 which has the same diameter as the extruded trough 238 in the pivot column 14. When it is desired to insert the end 234 of the arm 30 into the groove 232, all the installer need do is tap the free end of the arm with a hammer and the spring 242 gives way sufficiently so that the arm can come to rest locked in position with the troughs 236 and 238 facing each other. The spring at this point returns to its normal shape but is yet held in compression laterally, instead of vertically, and maintains the arm 30 locked in position. It has been determined that this type of locking means is sufficiently strong to hold the arm in place in the pivot column 14 against attempts to pull the arm out of the slot or groove 232.

However, one could with a suitable tool (not illustrated), tighten the spring and allow the arms then to be removed from the pivot column as is necessary. Such a tool would extend between the coils of the spring and, when rotated, tighten or wind the spring into a smaller coil diameter so that the arm 30 could be pulled out. While the length of the spring 242 can be any desired length, it is anticipated that perhaps springs of up to three (3) foot length can be provided with two such springs being installed in order to form a six (6) foot length which is normally the height of the pivot column itself. The use of such springs 242 as the locking means for the arms enables a manufacturer to ship a turnstile unassembled in a carton to the point of use where the arms can be locked into place in the pivot column. Shipping the turnstile in an unassembled condition saves space and hence shipping costs.

The invention has now been described with reference to the preferred and alternate embodiments. Obviously, alterations and modifications will occur to others upon a reading and understanding of this specification. It is intended to include all such modifications and alterations insofar as they come within the scope of the appended claims or the equivalents thereof.

Having thus described the preferred and alternate embodiments, the invention is claimed as follows:

1. A rotary gate control assembly comprising:

a pivot rod on which the rotary gate is adapted to rotate;

a cam having a continuous cam surface with a plurality of lobes disposed at spaced intervals therealong for defining a plurality of rotary gate home positions, said cam being operatively secured to said pivot rod; and, a first control means for selectively allowing a rotational movement of said cam, wherein said first control means comprises an elongated bar having an axis, a flat side and a round side, said bar being selectively rotatable around its axis to present one of said flat side and said round side to said cam surface and a means for selectively rotating said elongated bar, said bar flat side when facing said cam allowing a rotation of said cam and said bar round side when facing said cam preventing a rotation of said cam.

2. The assembly of claim 1 further comprising a second control means for selectively allowing a rotational movement of said cam for an angular extent at least equal to the angle defined between adjacent ones of said lobes, wherein said first and second control means are spaced from each other.

3. The assembly of claim 2 wherein said second control means comprises:

an elongated bar having an axis, a flat side and a round side and being selectively rotatable around its axis to present one of said flat side and said round side to said cam surface; and, a means for selectively rotating said elongated bar.

4. The assembly of claim 3 wherein said means for selectively rotating comprises a rotary solenoid.

5. The assembly of claim 1 further comprising a means for preventing a back-up of said cam.

6. The assembly of claim 5 wherein said means for preventing a back-up comprises a third member cooperatively positioned relative to said cam surface for selectively allowing a rotational movement of said cam for an angular extent equal to approximately one half the angle defined between adjacent ones of said lobes.

7. A rotary gate control assembly comprising:

a pivot rod on which the rotary gate is adapted to rotate;

a cam having a continuous cam surface with a plurality of lobes disposed at spaced intervals therealong for defining a plurality of rotary gate home positions, said cam being operatively secured to said pivot rod;

a first ball cooperatively positioned relative to said cam surface and selectively in operative engagement with said cam surface for preventing a rotational movement of said cam for an angular extent greater than the angle defined between adjacent ones of said plurality of lobes; and, a first means for selectively moving said first ball into and out of a rotation preventing relationship with said cam surface.

8. The assembly of claim 7 further comprising:

a second ball cooperatively positioned relative to said cam surface and selectively in operative engagement with said cam surface for preventing a rotational movement of said cam for an angular extent greater than the angle defined between adjacent ones of said plurality of lobes; and, a second means for selectively moving said second ball into and out of a rotation preventing relationship with said cam surface.

9. The assembly of claim 8 further comprising:

a third ball cooperatively positioned relative to said cam surface and selectively in operative engagement with said cam surface for preventing a rotational movement of said cam for an angular extent approximately equal to one half of the angle defined between adjacent ones of said plurality of lobes; and, a third means for selectively moving said third ball into and out of a rotation preventing relationship with said cam surface.

10. The assembly of claim 7 further comprising at least one cam follower for engaging said cam surface.

11. The assembly of claim 10 wherein said first means for selectively moving comprises a rotary solenoid.

12. The assembly of claim 7 wherein said first means for selectively moving comprises a push-pull solenoid.

13. The assembly of claim 7 wherein said first means for selectively moving comprises a rotary solenoid, a rotatable rod secured at one end to said solenoid and a second spaced from said first ball by said rod.

14. A rotary gate control assembly comprising:

a pivot rod on which the rotary gate is adapted to rotate;

a cam having a continuous cam surface with a plurality of lobes disposed at spaced intervals therealong for defining a plurality of rotary gate home positions, said cam being operatively secured to said pivot rod;

a first element cooperatively positioned relative to said cam surface and in operative engagement with said cam surface for preventing a rotational movement of said cam;

a first means for selectively moving said first element into and out of a rotation preventing relationship with said cam surface;

a second element cooperatively positioned relative to said cam surface and in operative engagement with said cam surface for preventing a rotational movement of said cam; and, a second means for selectively moving said second element into and out of a rotation preventing relationship with said cam surface, wherein said first and second elements each comprise a ball cooperatively positioned relative to said cam surface and selectively in operative engagement with said cam surface.

15. The assembly of claim 14 further comprising a control head having an interior cavity in which said cam is mounted for rotation, and including spaced bores for mounting said first and second elements.

16. The assembly of claim 14 further comprising a means for preventing a back up of said cam.

17. A rotary gate control assembly comprising:

a pivot rod on which the rotary gate is adapted to rotate;

a cam having a continuous cam surface with a plurality of lobes disposed at spaced intervals therealong for defining a plurality of rotary gate home positions, said cam being operatively secured to said pivot rod;

a control head having an interior cavity in which said cam is mounted for rotation;

a first ball member cooperatively positioned in said control head relative to said cam surface for selectively preventing a bi-directional rotational movement of said cam generally for an angular extent at least equal to an angle defined between adjacent ones of said lobes, said first ball member being movable in a direction normal to a plane of said cam to allow a rotation of said cam; and, a second ball member cooperatively positioned in said control head relative to said cam surface for selectively preventing a bi-directional rotational movement of said cam for an angular extent at least equal to the angle defined between adjacent ones of said lobes, said second ball member being movable in a direction normal to a plane of said cam to allow a rotation of said cam.

18. The assembly of claim 17 wherein said assembly further comprises:

a first rod, secured to a first solenoid, which selectively urges said first ball member against said cam surface; and, a second rod, secured to a second solenoid, which selectively urges said second ball member against said cam surface.

19. The assembly of claim 17 wherein said control head comprises:

a base section;

a cover plate, wherein said cavity is defined between said base section and said cover plate; and, a first fastening means for securing said cover plate to said base section.

20. The assembly of claim 17 further comprising an upper frame member which supports said rotary gate and a second fastening means for securing said control head to said upper frame member.

* * * * *